United States Patent [19]

Delli Bovi et al.

[11] Patent Number: 4,738,649

[45] Date of Patent: Apr. 19, 1988

[54] FIGURE TOY WITH PUNCHING ARM MECHANISM

[75] Inventors: Robert Delli Bovi, Westfield; Brian Fontaine, Southbridge, both of Mass.

[73] Assignee: Coleco Industries, Inc., West Hartford, Conn.

[21] Appl. No.: 827,339

[22] Filed: Feb. 7, 1986

[51] Int. Cl.[4] ..... A63H 13/06

[52] U.S. Cl. ..... 446/336; 446/383

[58] Field of Search ..... 446/333, 334, 335, 336, 446/352, 353, 354, 359, 330, 308, 486

[56] References Cited

U.S. PATENT DOCUMENTS

| | | | |
|---|---|---|---|
| 703,899 | 7/1902 | Debes . | |
| 719,310 | 1/1903 | Debes . | |
| 807,664 | 12/1905 | Debes . | |
| 2,538,744 | 1/1951 | Berry . | |
| 2,942,377 | 6/1960 | Beebe . | |
| 3,264,779 | 8/1966 | Bonanno . | |
| 3,377,740 | 4/1968 | Bonanno et al. . | |
| 3,425,153 | 2/1969 | Bonanno et al. . | |
| 3,684,291 | 8/1972 | Johmann . | |
| 3,699,713 | 10/1972 | Sapkus et al. . | |
| 3,769,745 | 11/1973 | Crosman | 446/359 X |
| 3,906,661 | 9/1975 | Weiser | 446/336 X |
| 3,955,311 | 5/1976 | Lyons et al. . | |
| 3,978,611 | 9/1976 | Strongin . | |
| 4,003,158 | 1/1977 | Wolf et al. . | |
| 4,006,555 | 2/1977 | England et al. . | |
| 4,031,657 | 6/1977 | Crosman et al. . | |
| 4,573,944 | 3/1986 | Crow et al. | 446/336 X |

*Primary Examiner*—Mickey Yu

[57] ABSTRACT

An action toy figure has a spring-powered rotatable arm which is capable of simulating a pummelling action. It employs a spring motor, with a pawl-activated ratchet-clutch arrangement which permits full winding while protecting the mechanism against damage due to excessive rotation of the "puncher arm" in either direction.

14 Claims, 4 Drawing Sheets

FIG. 6
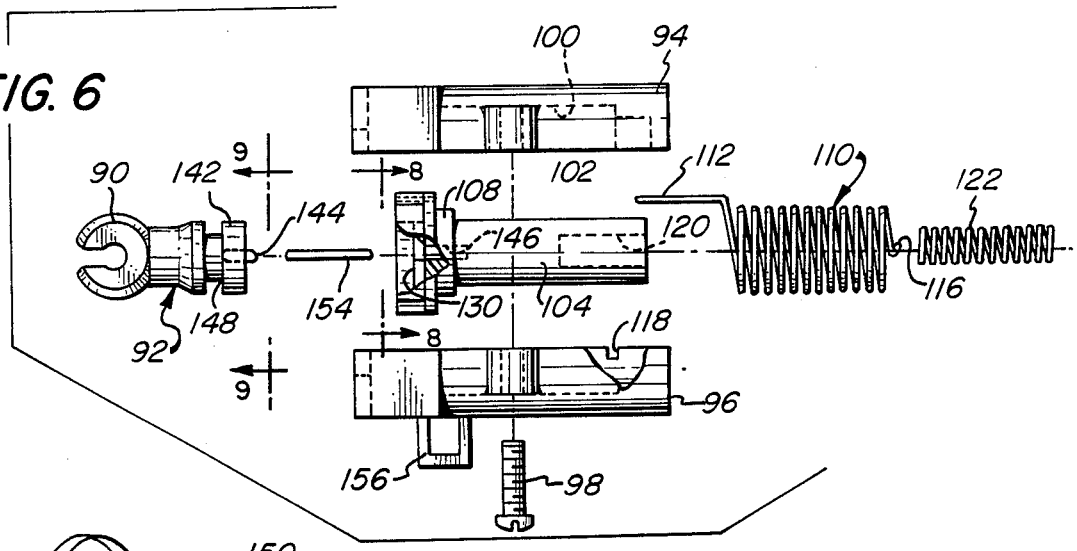
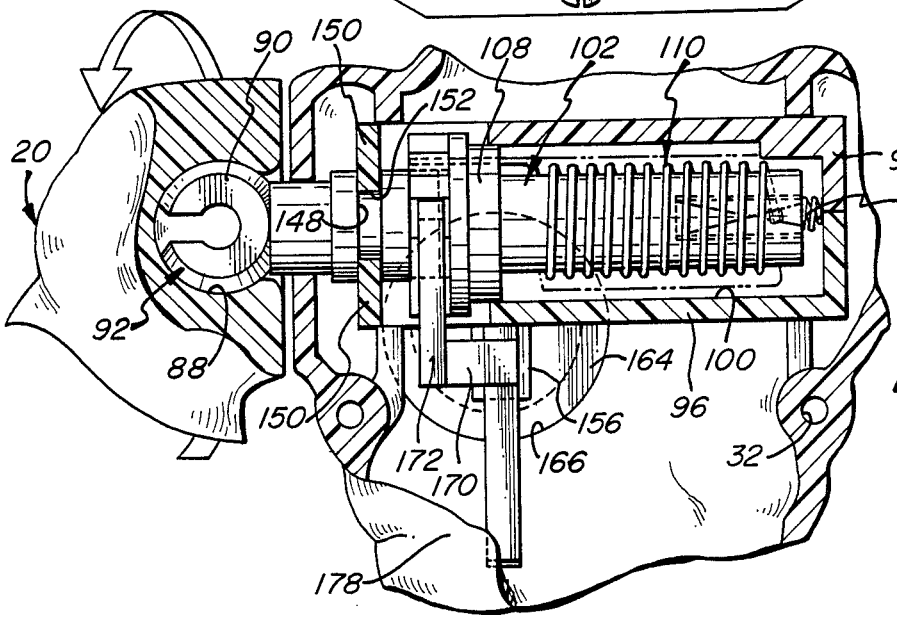
FIG. 7
FIG. 8
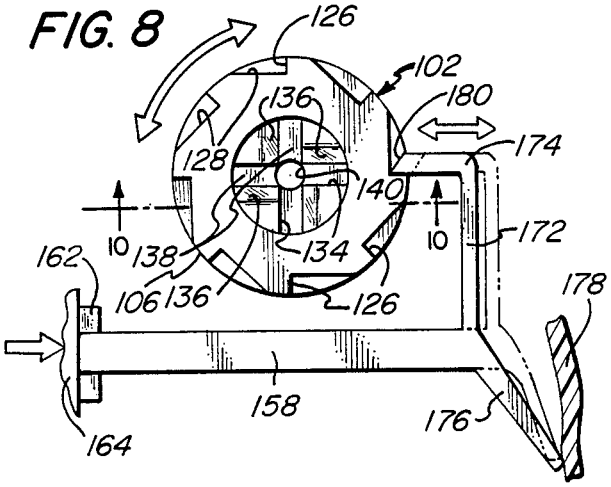
FIG. 9
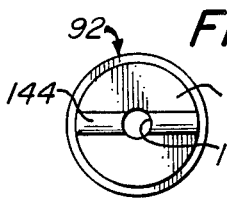
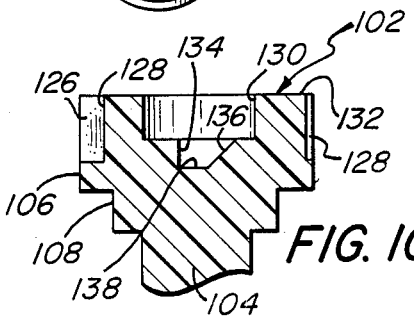
FIG. 10

FIGURE TOY WITH PUNCHING ARM MECHANISM

BACKGROUND OF THE INVENTION

An ongoing demand exists for action toys having novel features. It is of course important that any such toy be effective in its appearance and operation, while also being durable and relatively facile and inexpensive to manufacture. The prior art discloses numerous forms of action toys in which various parts can be moved and disposed in different ways; typical are the following U.S. patents:

Beebe U.S. Pat. No. 2,942,377 shows a spring-powered mechanism for effecting return of the arm of a doll from a deflected position, using a lever actuated through pressure applied to the body. The arm is operatively disengageable to permit independent variation of its position.

Bonanno U.S. Pat. No. 3,264,779 discloses delay mechanisms for an animated toy, wherein a torsion spring is loaded by turning a movable part and is released by operation of a latch, through the application of pressure on the doll body. It employs helical braking springs wound about operating drums.

Bonanno et al U.S. Pat. No. 3,377,740 shows a doll having spring-loaded arms which are actuated by the application of force upon a lever within its body. The mechanism includes a latching element which is urged axially into contact with a tiltable part having an engagement lug thereon.

In Bonanno et al U.S. Pat. No. 3,425,153, one of the arms of an animated toy doll is connected to a spindle within a housing, and is loaded against the force of a spring and latched by an internal sliding element.

Lyons et al U.S. Pat. No. 3,955,311 discloses a toy figure having an animated arm actuated by a mechanism that includes a clutch arrangement. The arm can be moved manually between lowered and raised positions, and is held in place by the mechanism.

In U.S. Pat. No. 4,003,158, Wolf et al describe a fighting doll wherein the arms incorporate a ratchet form of slip clutch arrangement.

A crescent-shaped elastic insert for a ball and socket joint, used to connect articulated doll parts, is disclosed in Debes U.S. Pat. No. 703,899. Similar inserts are shown in Debes U.S. Pat. Nos. 719,310 and 807,664.

It is the broad object of the present invention to provide a novel action toy figure having a spring-powered rotatable appendage.

It is also an object of the invention to provide such a toy figure which includes a unique spring motor adapted to provide the power for the rotatable appendage.

A more specific object of the invention is to provide unique actuating means in connection with such a spring motor.

Another object of the invention is to provide such a toy which incorporates a unique clutch arrangement to protect the mechanism from damage in both directions of rotation.

An additional more specific object is to provide a toy figure in the form of a human, which is capable of producing a punching action with its rotatable appendage, and which may additionally have a leg-simulating member attached in a unique way to the trunk of the figure.

Additional objects of the invention are to provide such a toy figure which is effective in its appearance and utility, is durable, and is relatively facile and inexpensive to manufacture.

SUMMARY OF THE INVENTION

It has now been found that certain of the foregoing and related objects of the invention are attained by the provision of an action toy figure having a spring-powered rotatable appendage, which includes a body, a spring motor mounted within the body and having a mounting piece with an end portion protruding from it, an appendage affixed upon the end portion of the mounting piece, and means for actuating the spring motor from externally of the body. The spring motor employed comprises a housing having an elongated chamber, and a rotor having a cylindrical barrel portion and a ratchet wheel portion thereon. The rotor is mounted with its barrel portion disposed within the chamber of the housing and coaxial with the longitudinal axis thereof, for rotation thereabout, and the axis of rotation of the wheel portion is also aligned therewith.

A pawl member is mounted within the body of the figure for reciprocal movement into and out of engagement with the wheel portion of the rotor; it serves to permit rotation of the rotor in only one direction when engaged, and is operatively connected to the actuating means. The motor also includes a coiled torsion spring, which is disposed within the chamber and about the barrel portion of the rotor with one end attached to it. The opposite end is attached to the housing, and the spring is adapted to wind in the "one" direction of rotor rotation. Clutch means is operatively interposed between the mounting piece and the rotor. It functions to interengage the mounting piece and rotor for conjoint movement in the "one" direction, to enable winding of the torsion spring by rotation of the appendage, and to permit relative rotation therebetween when the spring is in a fully wound condition. The clutch means also interengages the mounting piece and rotor for conjoint movement in the opposite direction, to rotate the appendage when the spring unwinds, and permits relative rotation in that direction, at least at a certain point beyond that at which the spring is unwound.

The housing of the motor will desirably rotatably mount the mounting piece in a fixed axial position, with the rotor being axially shiftable within the housing, toward and away from the mounting piece, to effect engagement and disengagement of the clutch means, respectively; normally, it will be maintained in engaged condition by the inclusion of means for biasing the rotor toward the mounting piece. The clutch means will advantageously be provided by confronting end portions on the mounting piece and rotor, one of which clutch portions will have an axially projecting element thereon, the other portion having an axially extending recess which is dimensioned and configured to engage the projecting element so as to couple the mounting piece and rotor for conjoint rotation. Axial shifting of the rotor away from the mounting piece will of course separate the clutch portions, permitting the element to disengage from the recess and thereby permitting relative rotation to occur.

More particularly, the axially projecting element may be a rib extending diametrically of the axis of rotation of the mounting piece, on an end surface thereof, with the recess being provided by groove portions which are aligned diametrically of the axis of rotation of the rotor and are formed into an end surface thereof. Most desirably, one side of each groove portion will be defined by an axially oriented sidewall so as to engage the rib in the "one" direction of rotation, with both of such sidewalls being angularly offset from the diametrical axis in the same direction. The sidewall defining the opposite side of each groove portion will normally be inclined, to thereby facilitate movement of the rib from the groove in the opposite direction.

Both the ratchet wheel portion and also the clutch portion of the rotor will desirably be disposed on the same axial section at one end of the rotor, with the wheel portion comprising a multiplicity of circumferentially extending notches and with the clutch portion comprising a recess extending axially into the end surface of the rotor. The axial biasing means for the rotor will normally be a coil spring, and the opposite end portion of the rotor will be formed with an axial bore to seat it in contact upon an adjacent surface of the housing.

The pawl member will advantageously be slidable in the general plane of the axial section of the rotor on which the wheel portion is disposed, and it may include an actuating arm that extends on an anterior-posterior axis of the body with the motor housing being oriented transversely therewithin. Preferably, the pawl member will include an integrally formed biasing element disposed to bear upon an inside wall surface of the body, and the body will have a depressible button element formed into an opposite wall portion, the button element being engaged upon the adjacent end of the pawl member actuating arm and providing the spring motor actuating means. The pawl member will also desirably include a ratchet arm that extends generally perpendicularly to the actuating arm, and that has a dog thereon disposed to engage the notches of the ratchet wheel member.

The elongated chamber of the motor will usually be generally cylindrical, and will provide a space of annular cross section about the rotor barrel portion. The clutch means must provide a limited level of interengagement between the mounting piece and rotor sufficient to produce conjoint movement thereof in the "opposite" (unwind) direction of rotation, so as to thereby drive the punching arm. The inside surface of the housing will therefore desirably be close enough to engage the expanding torsion power spring disposed therewithin, to ensure disengagement of the clutch means before any damage to the mechanism can occur.

In particularly preferred embodiments, the body of the figure will simulate a human trunk and the appendage will simulate an arm thereon, with the mounting piece providing a shoulder joint about which the arm will rotate in a pummelling action when driven by the spring motor. Such a figure may additionally include a second appendage attached to the trunk to simulate a leg. The leg will desirably employ a thigh member comprised of lateral sections that are assembled to one another with interengaging pin and socket elements, which provide a transverse supporting part. It will also have a recess formed into one end, and will include an insert with a hemispherical socket portion seated within the recess and providing a lining for the hip joint. The insert will include a tab portion extending from the socket portion, with the tab portion having an aperture therein through which extends the supporting part provided by the pin and socket elements, to thereby secure the insert in position between the thigh member sections. A generally spherical element provided in the hip region of the trunk member will be seated within the socket portion of the insert, to thereby mount the leg upon the trunk for facile articulation. The trunk member will normally have a leg opening in its hip region, and will advantageously include an internal skeleton member providing the spherical element disposed therewithin.

DESCRIPTION OF THE DRAWINGS

FIG. 6 is an exploded front view showing the several parts of the spring motor employed in the toy of the invention, and also showing the mounting piece for the enlarged arm member;

FIG. 7 is a fragmentary front view of the upper portions of the trunk and enlarged arm member of the figure, showing the torsion power spring in unwound condition;

FIG. 8 is a fragmentary end view of the rotor of the motor, taken along line 8—8 in FIG. 6, and also showing the slidable pawl member which engages (full line) the ratchet wheel portion of the rotor during winding of the spring, and which is disengaged (phantom line) therefrom to release its energy;

FIG. 9 is an end view of the mounting piece for the powered arm member, taken along line 9—9 of FIG. 6 and drawn to the scale of FIG. 8;

FIG. 10 is a fragmentary section view taken along line 10—10 of FIG. 8, showing the end section of the rotor on which the ratchet and clutch features are provided;

DETAILED DESCRIPTION OF THE ILLUSTRATED EMBODIMENTS

Figure 1:
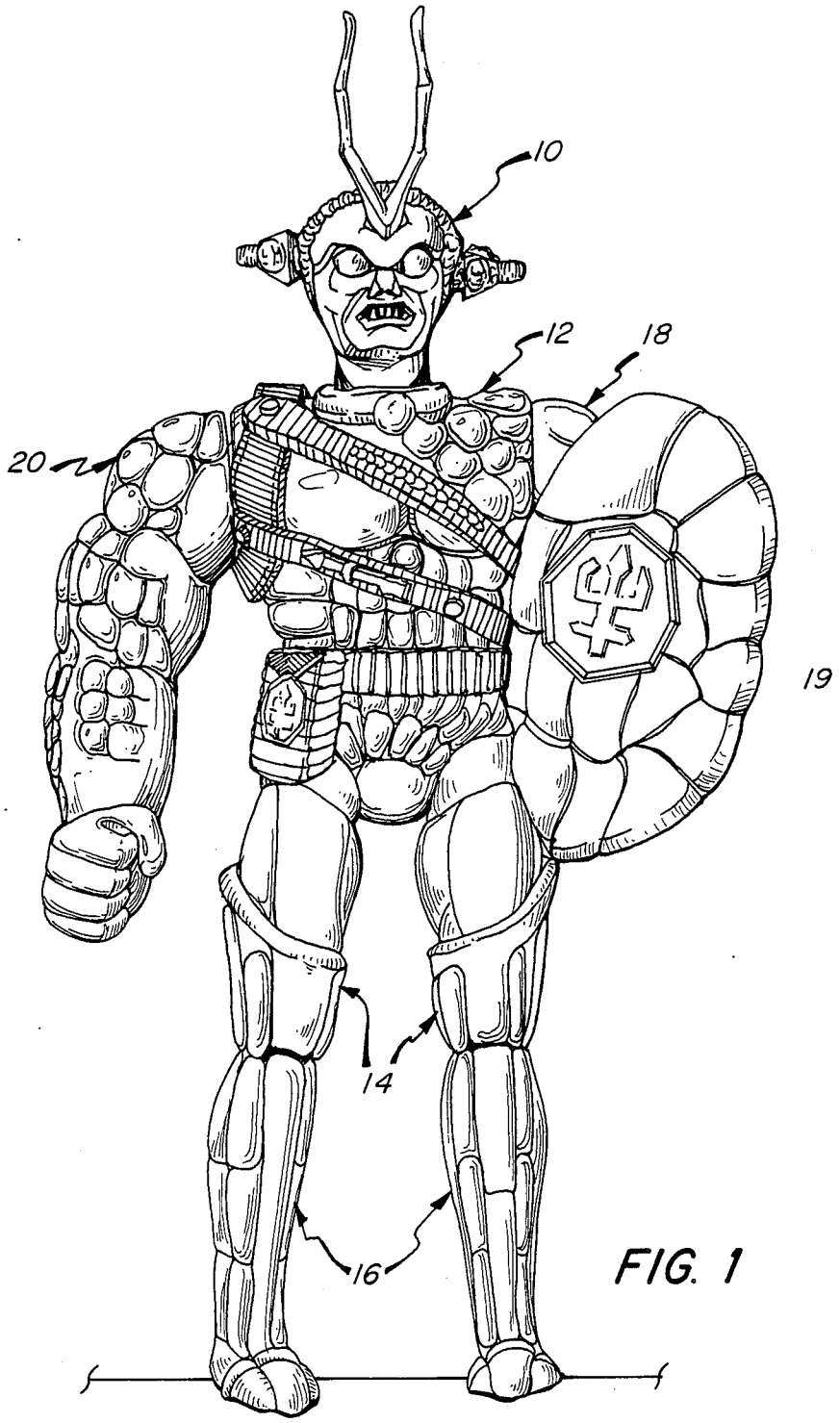
FIG. 1 is a perspective view of a toy figure embodying the present invention.
Figure 2:
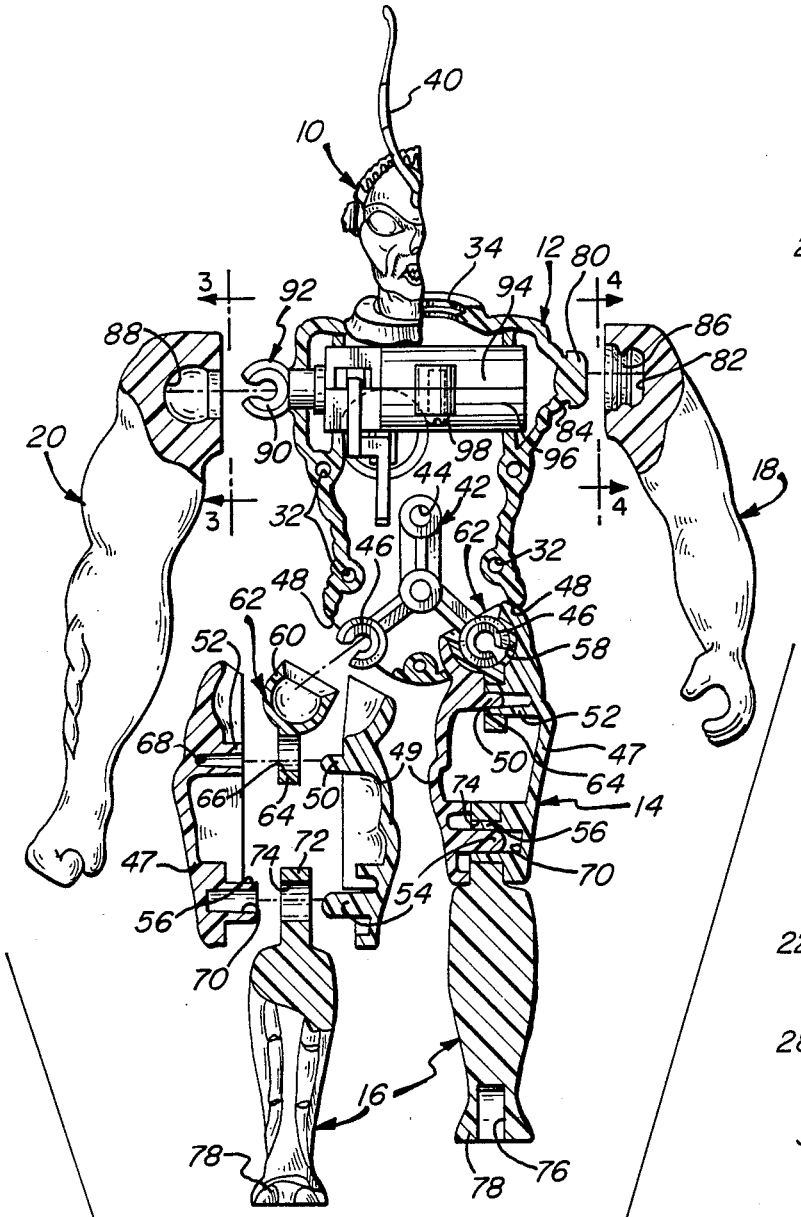
FIG. 2 is an exploded front view of the toy figure of FIG. 1, drawn to a reduced scale and showing portions in section.

Turning now in detail to the appended drawings, FIGS. 1 and 2 show a toy figure embodying the present invention, which is of humanoid form. It will be understood that the science fiction motif reflected by the figure is non-limiting, and that toys embodying the invention may of course take any of a wide diversity of forms.

The figure comprises of a head member, a trunk member, a pair of thigh members, and a pair of leg or shank members, generally designated by the numerals 10, 12, 14 and 16, respectively. It also includes two arm members, generally designated by the numerals 18 and 20, the arm member 20 being outsized and considerably larger than arm member 18.

The trunk member 12 is comprised of anterior and posterior sections 22, 24, which are assembled with one another and have a cooperating arrangement of pin and socket elements 26, 28 extending transversely therethrough, the end of the pin member 26 being frictionally engaged within the socket 30. As suggested by the openings 32 formed into the posterior section 24 (note FIG. 2), additional pin and socket elements cooperate to facilitate assembly; the sections will normally be permanently affixed to one another by conventional means, such as ultrasonic welding, adhesive bonding, or the like.

The sections define a circular opening 34 at the upper end of the trunk member 12, within which is rotatably mounted the head member 10. It is formed of a relatively resilient material (e.g., 80 Durometer value polyvinyl chloride) and is held in place by a rigid plug 36, which is inserted into the passage 38 of the neck portion from within the trunk member; an antenna-simulating element 40 is attached in the forehead area.

An armature piece, generally designated by the numeral 42, is supported between the trunk member sections 22, 24 by insertion of the pin element 26 through the aperture 44. As can be seen, it is of inverted Y-shaped configuration, and has generally spherical formations 46 on the outer ends of its two lower arms; the armature is so positioned that the spherical portions 46 are located substantially within openings 48 formed in the hip region of the trunk member.

Each thigh member 14 is comprised of two lateral sections, 47, 49, which are assembled with one another by use of interengaging pin and socket elements 50, 52, 54, 56. The sections cooperatively define a relatively large, generally spherical socket 58 in the upper end of each thigh member, within which is seated the hemispherical portion 60 of an insert, generally designated by the numeral 62. A tab element 64 projects at an obtuse angle to the axis of the portion 60 of each insert 62, and has an aperture 66 through which extends a collar portion of the socket element 52 of the associated thigh member section 47 so that the inserts are securely mounted when the thigh sections are assembled. As will be noted, the spherical portions 46 on the downwardly directed arms of the armature piece 42 are engaged within the socket portions 60 of the inserts, and thereby cooperatively provide pivotable mountings for the associated thigh members. The insert pieces 62 will generally be fabricated from a synthetic resinous material, which will be selected to provide optimal characteristics for the assembly. For example, by using PVC for the inserts and an acetal polymer for the armature, durable joints are provided about which the thigh members are readily articulated and set into different positions, which positions tend to be maintained due to inherent frictional forces, attributable to the particular resins selected.

Each leg member 16 has an upper portion 72 of reduced cross section, in which is formed a transverse aperture 74. The collar portion 56 of the lower socket element 56 on the thigh section 47 exends through the aperture 74 of the associated leg member 16 to pivotably mount it. The leg members 16 also have bores 76 extending into their foot portions 78, which are intended to receive pegs of a supporting plate (not shown) to provide a stable base for the figure, if so desired.

The trunk member sections 22, 24 cooperatively provide a generally spherical, knob-like projection 80 on one side of the body, which is engaged within a mating, inwardly opening socket 82 formed into the shoulder region of the arm member 18. The knob portion 80 and arm member 18 have cooperating circumferential groove and flange elements 84, 86 thereon, which permit snap-fit interengagement and rotatable mounting of the arm member 18; the body may be made of ABS copolymer and the arm may be fabricated of PVC to permit such assembly, and to afford desirable position-holding characteristics.

Figure 3:
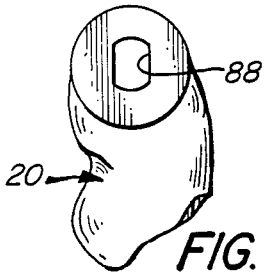
FIG. 3 is a fragmentary elevational view of the enlarged arm member of the figure, taken along line 3—3 of FIG. 2.
Figure 4:
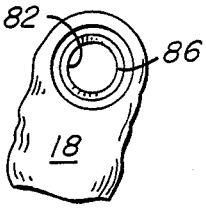
FIG. 4 is a view of the other arm member, similar to FIG. 3 and taken along line 4—4 of FIG. 2.
Figure 13:
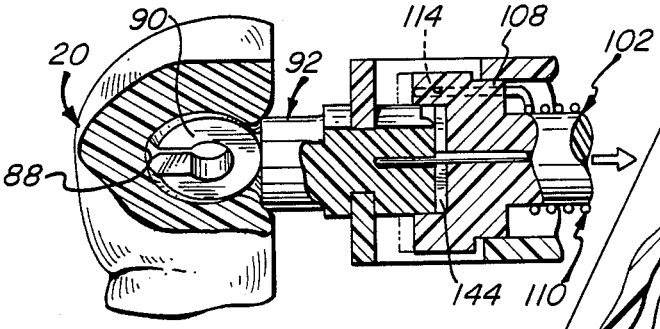
FIG. 13 is a view similar to FIG. 12, showing operation of the clutch means to disengage the mounting piece from the rotor upon movement of the arm member past the fully wound condition of the spring.

The enlarged punching arm 20 is similarly formed with an inwardly opening socket 88 in its shoulder region. As best seen in FIG. 3 however the socket 88 is of flat-sided oblong configuration, rather than being of circular cross section, to non-rotatably receive the outer end portion 90 of the mounting piece, generally designated by the numeral 92, which is (as perhaps best seen in FIG. 13) of generally toroidal configuration.

The mounting piece is in turn connected to the spring motor, which comprises an elongated housing provided by upper and lower halves 94, 96, disposed transversely within a chest cavity defined by the trunk member sections. The housing halves are secured to one another by a pair of screws 98, and together define a cylindrical chamber 100. A rotor, generally designated by the numeral 102, consists of a cylindrical barrel portion 104 and a larger diameter, coaxial ratchet wheel portion 106, and collar portion 108 therebetween; the diameter of the collar portion is intermediate those of the barrel and wheel portions, and is substantially the same as that of the housing chamber 100. The collar portion 108 thus provides a bearing surface by which the rotor 102 is rotatably and slidably mounted within the housing, with the barrel portion 104 coaxially disposed therewithin.

A torsion spring 110 extends about the barrel portion 104 of the rotor, with one end 112 seated in the hole 114 and with its opposite, hook-shaped end 116 engaged within the notch 118 formed into the lower motor housing half 96. An axial bore 120 is formed into the end of the barrel portion, and serves to seat a coil spring 122, the opposite end of which bears upon the end wall 124 of the housing to bias the rotor toward the mounting piece 92.

A series of notches are formed about the circumference of the ratchet wheel portion 106, each being defined by a radially extending surface 126 and a surface 128 extending secantially from the inner end thereof. The wheel portion also has a clutch component thereon, which is comprised of a generally circular recess 130 extending axially from its outer end surface 132, and four equidistantly spaced, radially extending groove portions. The groove portions are each defined by an axial wall element 134 on one side, an oblique wall element 136 on the other side, and a transverse wall element 138 therebetween; a small bore 140 extends inwardly, on the axis of the rotor, from the bottom of the recess 130.

The inner end portion 142 of the mounting piece 90 is of disc-like form, with a low rib element 144 extending diametrically across its inner face and with a bore 146 extending axially therefrom. A groove 148 extends circumferentially about the mounting piece 92 adjacent the disc portion 142, and serves to receive flange portions 150, which extend transversely from the housing halves 94, 96. The flange portions 150 define a circular aperture 152 within which the mounting piece 92 can rotate, and they secure it in a fixed axial position with respect to the housing. In assembly, the disc portion 142 of the mounting piece 92 is positioned within the circular recess 130 of the wheel portion 106, so that its rib element 144 is disposed to engage within the radial groove portions, the aligned pairs of which provide two perpendicular grooves extending diametrically thereacross; a pin 154 is seated within the bores 140, 146, and helps to retain the mounting piece and rotor in coaxial registration.

Figure 14:
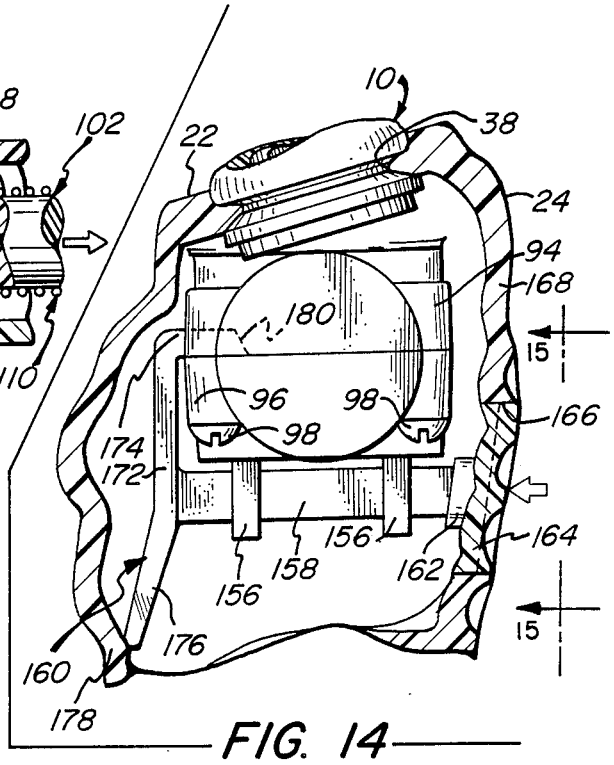
FIG. 14 is a fragmentary sectional view of the chest area of the trunk member.
Figure 15:
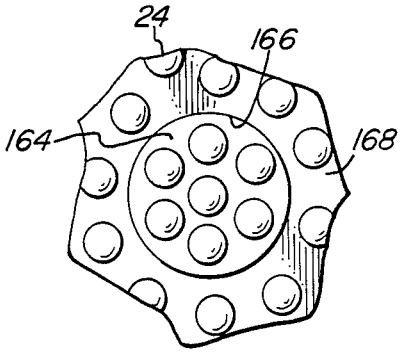
FIG. 15 is a fragmentary rear view of the trunk member, taken along line 15—15 in FIG. 14 and showing the section of back wall which includes the button for actuating the punching arm.

The lower housing half 96 has a pair of aligned, U-shaped guide elements 156 depending from it, through which extends the rectilinear actuating arm 158 of a ratchet pawl piece, generally designated by the numeral 160. One end of the arm 158 is seated within a collar formation 162 on the inner surface of a button element 164, which is in turn disposed within a circular opening 166 in the wall 168 of the rear trunk member section 24. As will be noted (see FIGS. 14 and 15), the button element 164 is formed to match the surface configuration of the wall 168, and therefore to be relatively unobtrusive.

At the opposite end of the actuating arm 158, the pawl piece 160 has a short laterally extending element 170, from which extends an upstanding ratchet arm 172 having an inwardly directed ratchet finger 174 at its upper end. An integrally formed, resilient biasing finger 176 projects downwardly and outwardly at the intersection of the actuating arm 158 and the element 170, and has its free end in contact with the wall of the front body section 22; hence, the biasing finger 176 urges the reversely directed ratchet finger 174 into engagement with the ratchet wheel portion 106 of the rotor 102.

Figure 5:
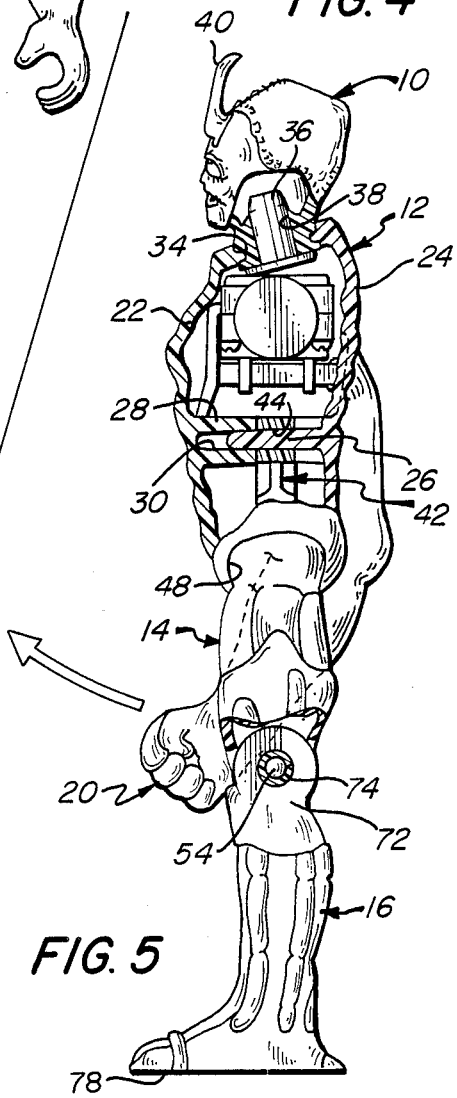
FIG. 5 is a side elevational view of the figure, shown in partial section and illustrating movement of the powered arm member in a pummelling action.
Figure 12:
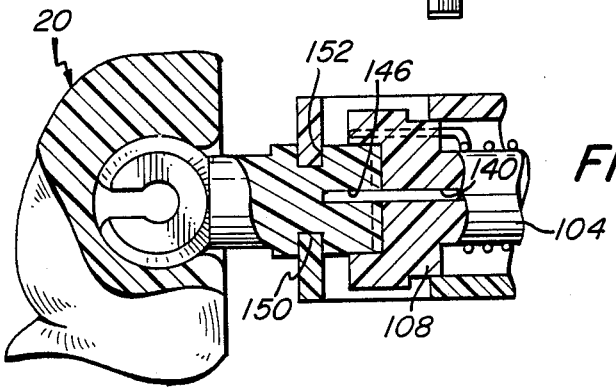
FIG. 12 is a fragmentary view in partial section of the parts shown in FIG. 11, with the torsion spring fully wound.

To condition the toy for operation, the enlarged punching arm 20 of the toy figure must first be rotated to wind the torsion spring 110 of the motor; to do so, the arm is turned in a counterclockwise direction (i.e., opposite to the direction of the arrow in FIG. 5). The mounting piece 92 will of course rotate with the arm member 20 and, through engagement of the rib 144 on its inner face with the axially extending surfaces 134 of a pair of groove portions on the ratchet wheel portion 106, it will cause the rotor 102 to turn (clockwise, as viewed in FIG. 8), thereby winding the spring 110. When fully wound, the spring will bear tightly upon the barrel portion 104 of the rotor, as shown in FIG. 12. Since rotation of the rotor beyond that point is restrained, turning the arm 20 further will simply cause the rotor to shift axially away from the mounting piece, disengaging the clutch components and permitting the arm to move relatively freely and without overstress of the torsion spring.

As will be appreciated, the ratchet wheel portion of the rotor functions to permit winding of the spring, and to maintain it in wound condition. Turning of the rotor will cause the pawl piece 160 to reciprocate within the guide elements 156, against the force of the flexible finger 176, as the secantal surfaces 128 defining the circumferential notches are brought to bear against the bevelled face 180 on the end of the ratchet piece finger 174. Rotation in the opposite direction is of course prevented by engagement of the finger 174 against the radial surfaces 126 of the notches, which are sequentially presented to it as the rotor turns.

When the spring has been wound sufficiently and the toy is to be operated, the user simply pushes upon the button element 164 at the back of the figure, thereby shifting the pawl piece 160 forwardly against the force of the resilient finger 176, to release the ratchet finger 174 from the notch of the wheel portion notch in which it is engaged. This will permit the torsion spring 110 to unwind, releasing the stored energy and powering the arm member 20 to simulate a pummelling action. It will of course be appreciated that sufficient interengagement must exist between the rib element 144 of the mounting piece 92 and the rotor 102 to achieve rotation, despite the inclination of the oblique clutch surfaces 136.

Figure 11:
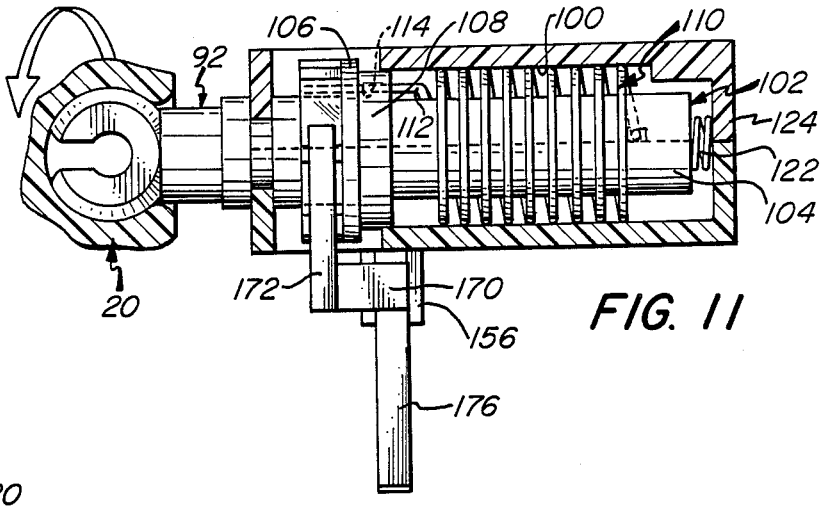
FIG. 11 is a sectional view of the spring motor and actuating pawl, with the rotor in its most extreme unwound condition, also showing a portion of the attached arm member.

It will also be appreciated that the presence of those surfaces permits the arm member 20 to be rotated beyond the fully unwound condition of the torsion spring with limited resistance. As noted previously, the rotor 102 is capable of shifting axially in the housing against the force of the coil spring 122, and the surfaces 136 function to cam it in that direction under the force exerted thereon by the rib element 144 moving thereover. Sufficient resistance is necessarily developed when the spring 110 expands into contact with the inner surfaces of the housing parts defining the cavity 100, as illustrated in FIG. 11, and the motor is thereby protected against damage from excessive unwinding.

Thus, it can be seen that the present invention provides a novel action toy figure having a spring-powered rotatable appendage, which utilizes a unique spring motor and actuating means. The toy figure is most desirably constructed in the form of a human which is capable of producing a punching action with its rotatable appendage, and which may additionally have a leg-simulating member attached in a unique way. The figure is effective in its appearance and utility, is durable, and is relatively facile and inexpensive to manufacture.

Having thus described the invention, what is claimed is:

1. An action toy figure having a spring-powered rotatable appendage, including: a figure body; a spring motor mounted within said body and having a mounting piece with an end portion thereon; an appendage affixed upon said end portion of said mounting piece; and means for actuating said spring motor from externally of said body, said spring motor comprising:

a housing having an elongated chamber therein;

a rotor having a cylindrical barrel portion and a ratchet wheel portion thereon, said rotor being mounted with said barrel portion disposed within said chamber of said housing and coaxial with the longitudinal axis thereof for rotation thereabout, and said wheel portion having its axis of rotation aligned therewith;

a pawl member mounted within said body for reciprocal movement into and out of engagement with said wheel portion, said pawl member permitting rotation of said rotor in only one direction when engaged with said wheel portion, and permitting rotation in both directions when disengaged therefrom, said pawl member being operatively connected to said actuating means to enable manual disengagement from said wheel portion;

a coiled torsion spring disposed within said chamber and about said barrel portion of said rotor with one end attached thereto and with the opposite end attached to said housing, said spring being adapted to wind in said one direction of rotor rotation; and clutch means operatively interposed between said mounting piece and said rotor, said clutch means interengaging said mounting piece and rotor for conjoint movement in said one direction, to enable winding of said torsion spring by rotation of said appendage, and permitting relative rotation therebetween in said one direction when said spring is in a fully wound condition, and said clutch means interengaging said mounting piece and rotor for conjoint movement in the opposite direction to rotate said appendage when said spring unwinds, and permitting relative rotation therebetween when said mounting piece is rotated in said opposite direction at a point therebeyond.

2. The figure of claim 1 wherein said housing rotatably mounts said mounting piece in a fixed axial position, wherein said rotor is axially shiftable in said housing toward and away from said mounting piece to effect engagement and disengagement of said clutch means, respectively, and wherein said motor additionally includes means for biasing said rotor towards said mounting piece to normally maintain said clutch means in engaged condition.

3. The figure of claim 2 wherein said clutch means is provided by confronting end portions on said mounting piece and rotor, one of said end portions having an axially projecting element thereon, and the other of said portions having an axially extending recess formed thereinto dimensioned and configured to engage said element of said one end portion so as to couple said mounting piece and rotor for conjoint rotation, axial shifting of said rotor away from said mounting piece permitting said element to disengage from said recess and thereby permitting relative rotation between said mounting piece and rotor.

4. The figure of claim 3 wherein said axially projecting element is a rib element extending radially from the axis of rotation of said mounting piece on an end surface thereof, and wherein said recess is a groove portion extending radially from the axis of rotation of said rotor and is formed into an end surface thereof, one side of said groove portion being defined by an axially oriented sidewall.

5. The figure of claim 4 wherein the sidewall defining the opposite side of said groove portion is inclined to facilitate movement of said rib from said groove portion thereon, said axially oriented sidewall being disposed to engage said rib in said one direction of rotation.

6. The figure of claim 2 wherein said rotor biasing means comprises a coil spring, and wherein said rotor has a bore extending axially into the end portion thereof remote from said mounting piece, said coil spring being seated in said bore and bearing upon an adjacent surface of said housing to so bias said rotor.

7. The figure of claim 1 wherein said wheel portion and said end portion of said rotor are both disposed on the same axial section thereof, said wheel portion comprising an array of notch formations extending circumferentially about said axial section, and said end portion comprising a recess extending axially from said end surface of said rotor.

8. The figure of claim 7 wherein said pawl member is slidable in the general plane of said axial section of said rotor, and has means biasing it toward said ratchet wheel portion.

9. The figure of claim 8 wherein said pawl member includes an actuating arm extending generally on an anterior-posterior axis of said body, and wherein said spring motor housing is disposed transversely within said body and perpendicularly to said anterior-posterior axis.

10. The figure of claim 9 wherein said pawl member includes an integrally formed spring element disposed to bear upon an inside wall surface of said body and providing said biasing means thereof, and wherein said body has a depressible button element formed into an opposite wall portion thereof, said button element being engaged upon the adjacent end of said actuating arm and providing said spring motor actuating means.

11. The figure of claim 10 wherein said pawl member further includes a ratchet arm extending generally perpendicularly to said actuating arm from the other end thereof and having an engaging dog thereon, said dog being disposed to engage said notch formations of said wheel member.

12. The figure of claim 11 wherein said housing has a support piece thereon within which said actuating arm of said pawl member is slidably supported.

13. The figure of claim 1 wherein said housing chamber is generally cylindrical and provides a space of annular cross section about said rotor barrel portion within which said torsion spring can expand, and wherein said clutch means effects disengagement of said mounting piece and rotor when rotation of said rotor in said opposite direction is restrained, the inside surface of said housing defining said chamber being sufficiently close to said spring that, upon forced unwinding in said opposite direction, said spring will expand into binding engagement with said surface, thereby restraining rotation of said rotor and ensuring disengagement of said clutch means.

14. The figure of claim 1 wherein said body simulates a human trunk and said appendage simulates an arm thereof, said mounting piece providing a shoulder joint about which said arm rotates in a pummelling action when driven by said spring motor.

* * * * *